United States Patent [19]

Lehmann et al.

[11] Patent Number: 4,708,683

[45] Date of Patent: Nov. 24, 1987

[54] TOY CAR CARRIER

[76] Inventors: Roger W. Lehmann, 18 Flintlock Ct., Bernardsville, N.J. 07924; Michael I. Satten, 4 Farmers Rd., Kings Point, N.Y. 11024

[21] Appl. No.: 924,611

[22] Filed: Oct. 29, 1986

[51] Int. Cl.[4] ..... A63H 17/06

[52] U.S. Cl. ..... 446/75; 446/428; 446/434

[58] Field of Search ..... 446/75, 76, 71, 427, 446/428, 434, 431, 465, 435; 206/216

[56] References Cited

U.S. PATENT DOCUMENTS

| | | | |
|---|---|---|---|
| 3,039,229 | 6/1962 | Van Cleemput | 446/434 |
| 3,675,366 | 7/1972 | Tomiyama | 446/434 |
| 4,192,093 | 3/1980 | Hamano | 446/427 |
| 4,433,504 | 2/1984 | Terui | 446/75 |
| 4,505,686 | 3/1985 | Mariol | 446/434 X |

*Primary Examiner*—Mickey Yu

*Attorney, Agent, or Firm*—Stoll, Wilkie, Previto & Hoffman

[57] ABSTRACT

A toy car carrier having handles which are movable between inoperative and operative positions. When in operative positions, the handles may be held to carry or propel the toy car carrier and to confine the toy cars to the toy car carrier. When the handles are moved to inoperative positions, they release the toy cars for removal from the toy car carrier.

In its preferred form, the toy car carrier is a tractor-trailer type of vehicle wherein both the tractor and the trailer are capable of carrying toy cars, and both are provided with ramps for toy car loading and unloading purposes. A coupling between the tractor and trailer has dual functions: to pivotally couple the tractor and trailer for normal use, and to lock the tractor and trailer relative to each other for carrying purposes.

13 Claims, 10 Drawing Figures

TOY CAR CARRIER

BACKGROUND AND SUMMARY OF THE INVENTION

This invention relates to toy car carriers simulating those used for highway transportation of full size passenger cars and other vehicles.

The most pertinent prior art known to applicants is comprised of the following U.S. patents:

Des. 156,244 Josefsberg
Des. 156,245 Josefsberg
Des. 193,150 Alvaney
3,030,22 Van Cleemput
3,594,951 Perhacs, Jr.
3,675,366 Tomiyama
4,192,093 Hamano
4,433,504 Terui
4,505,686 Mariol
4,516,948 Obara But although these patents show toy car carriers simulating full size car transport vehicles, e.g., Van Cleemput, U.S. Pat. No. 3,039,229, and carrying containers for toy cars, e.g., Terui, U.S. Pat. No. 4,433,504, they do not show a car carrier having handle means movable between inoperative and operative positions and, when in operative position, providing a pair of handles for carrying the car carrier and confining the toy cars therein. When the handle means are in inoperative position, they become unobtrusive side elements merged into the body of the car carrier. Nor do these patents disclose a coupling means which has pivotally operative and locked inoperative positions.

The principal object of the invention will be evident from the foregoing discussion, that is, to provide a new type of toy which simulates a conventional car carrying vehicle provides means for manually carrying the vehicle together with the toy cars contained therein. The coupling means is in pivotal position when the vehicle is in normal use; it is in locked position when the vehicle is manually carried.

DESCRIPTION OF THE INVENTION

Figure 5:
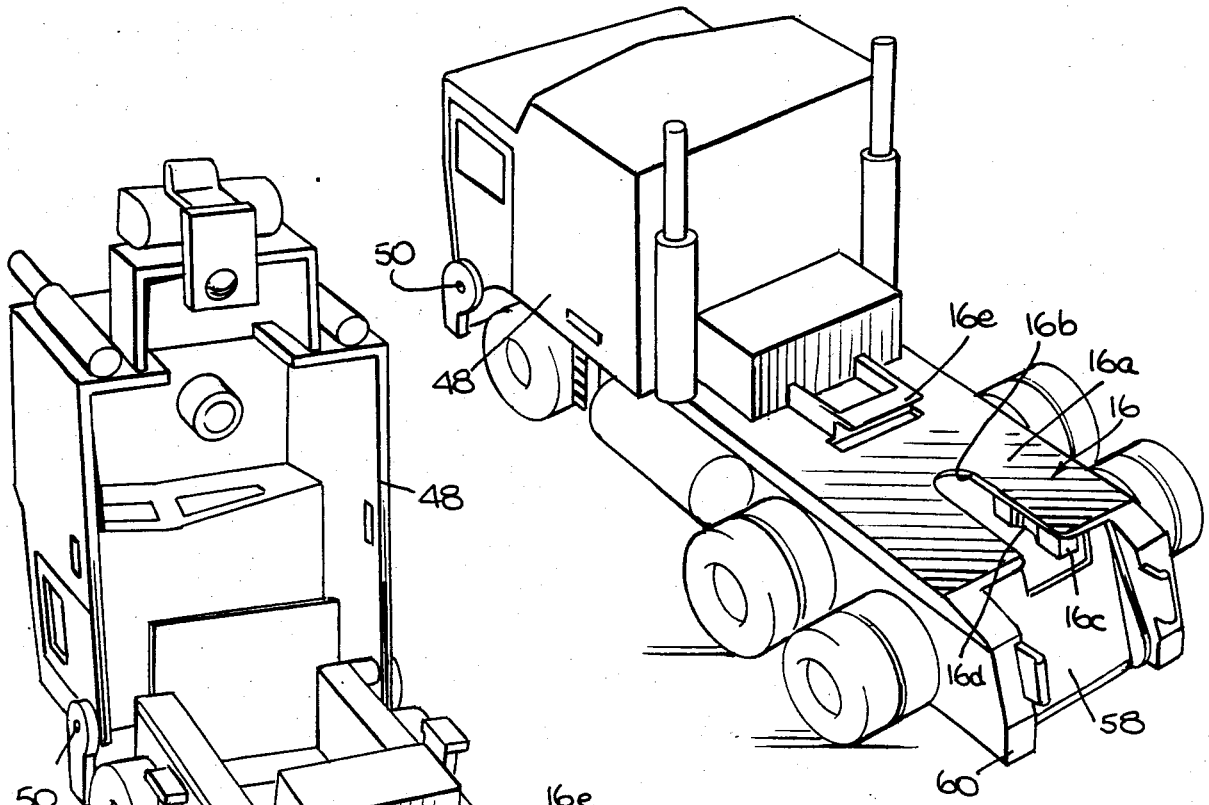
FIG. 5 is a perspective view of the tractor component of the toy car carrier.

The drawing depicts an illustrative toy car transport vehicle 10 which embodies the principles of the present invention. It comprises a tractor 12 and a trailer 14 and means for detachably coupling them together, specifically, a coupling mount 16 on the tractor and a coupler 18 on the trailer. Normally, the coupler and the coupling mount are engaged so that the vehicle operates as a unit. The tractor and trailer may, however, be uncoupled and used separately as is conventional with tractor-trailer trucks. FIG. 5 shows the tractor uncoupled from the trailer. When the trailer stands uncoupled from the tractor, it is supported on its rear wheels 20 and simulated forward wheels 22. The tractor is supported on conventional toy tractor wheels. See FIG. 5.

It will be observed that coupling mount 16 (FIG. 5) comprises a horizontal plate 16a having a longitudinal slot 16*b* formed therein, the forward end of said slot being closed, the rear end open. Diametrically opposed blocks 16c are connected to the bottom of the horizontal plate on opposite sides of the slot. Arcuate recesses 16*d* are formed in said blocks in facing relationship.

Figure 8:
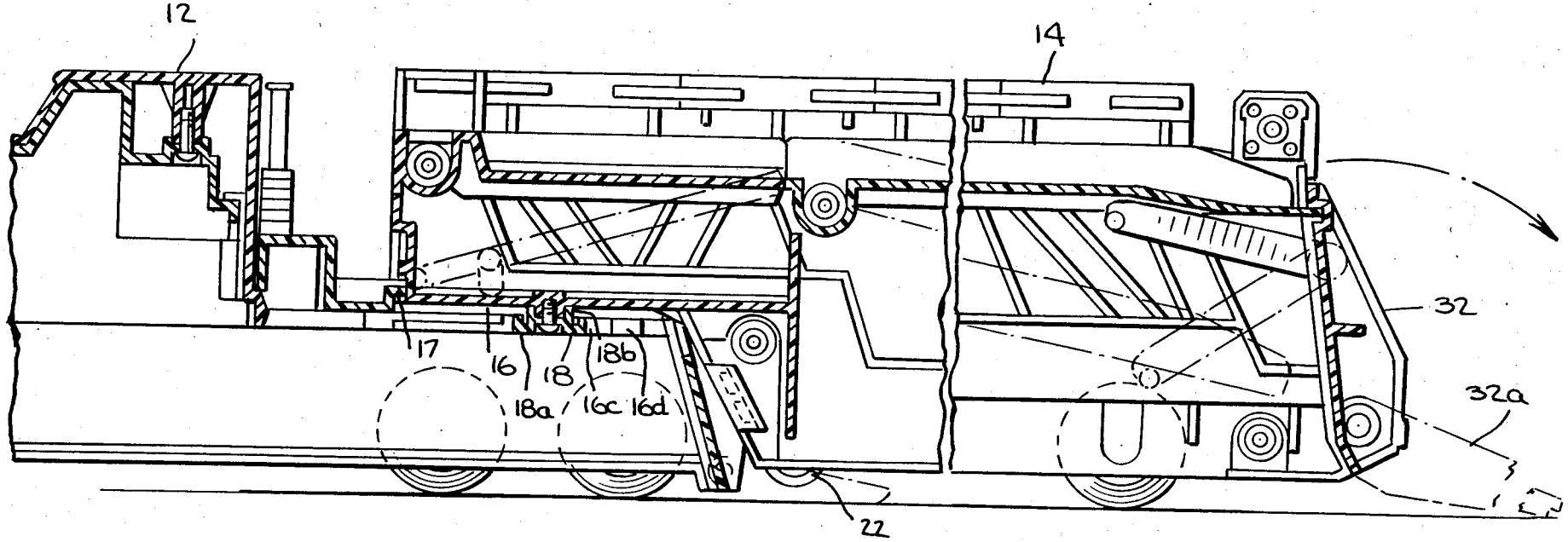
FIG. 8 is a fragmentary, vertical, longitudinal section on the line 8—8 of FIG. 7.
Figure 9:
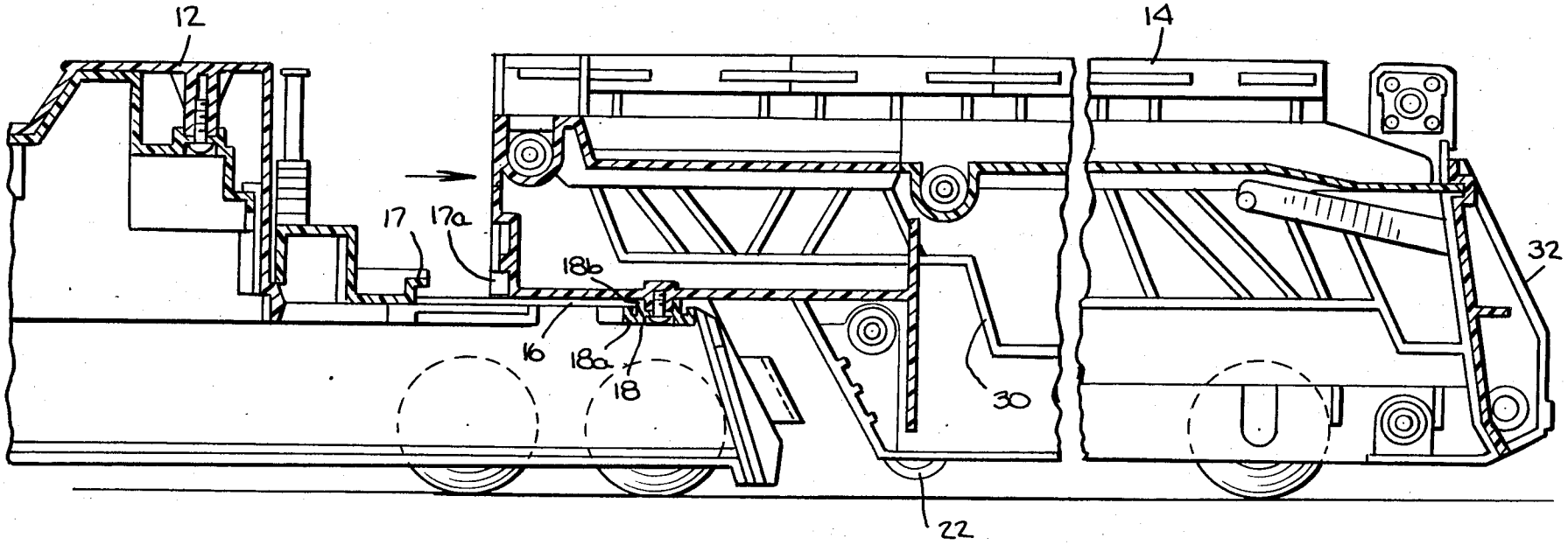
FIG. 9 is a view similar to that of FIG. 8, but showing the tractor and trailer pivotally coupled for normal use.
Figure 10:
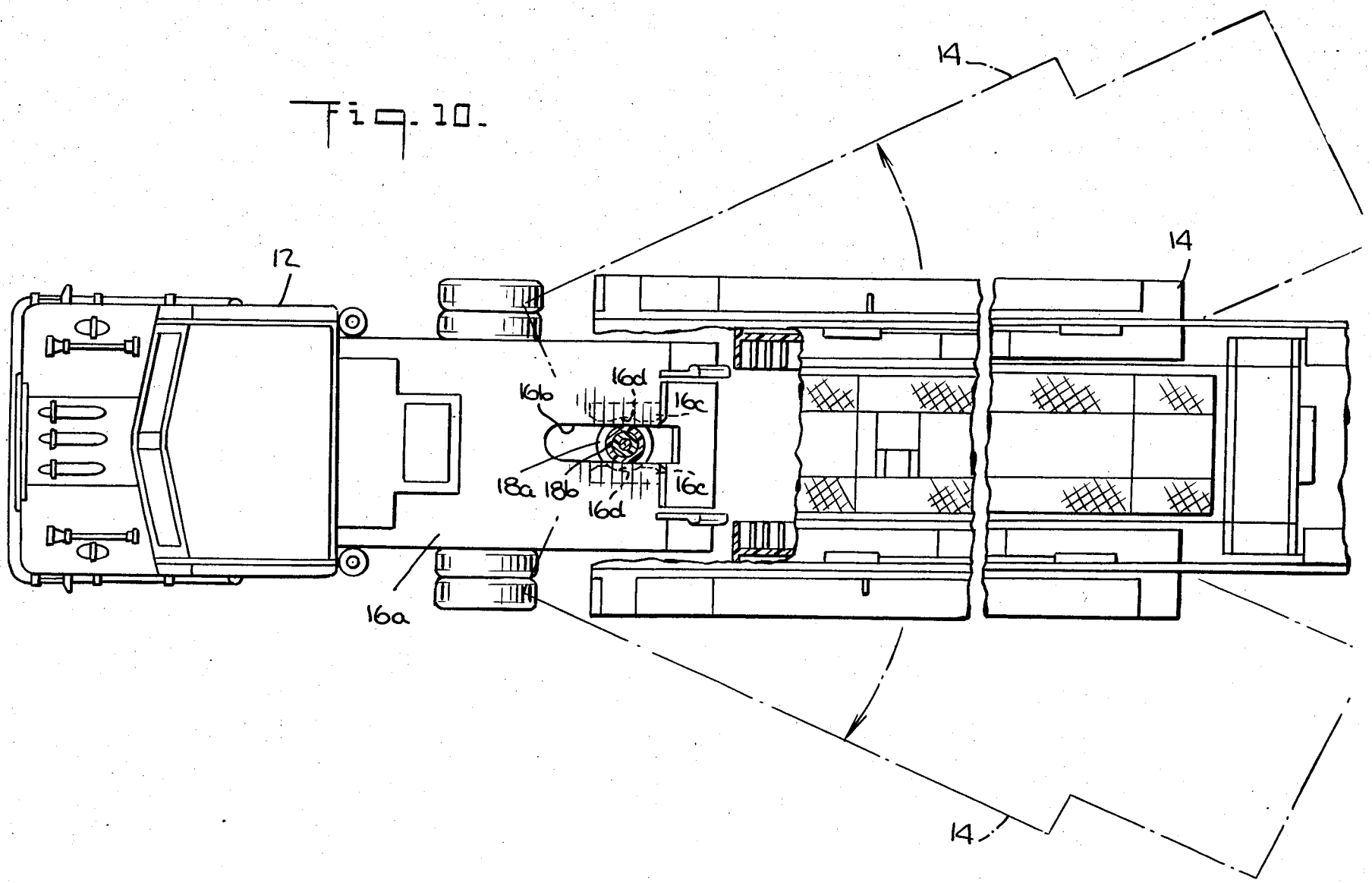
FIG. 10 is a fragmentary top view of the toy car carrier, partly broken away and in horizontal section to expose the coupling means in operative position.

It will also be observed (FIGS. 8 and 9) that coupler 18 comprises a disc-shaped element 18*a* having a reduced neck portion 18*b* which abuts horizontal plate 14*a* of the trailer. A pin 18*c* secures coupler 18 to said plate 14*a*, neck 18*b* serving as a spacer to space disc 18*a* from the plate. The longitudinal slot 16*b* extends along the longitudinal center of the tractor. The disc 18*b* is centered on the coupling axis of the tractor-trailer.

To couple the trailer 14 to the tractor 12, the tractor is backed toward the trailer, causing coupler 18 to enter slot 16*b*. Plate 16*a* of the tractor slides under plate 14*a* of the trailer causing the latter to be supported by the former. When the arcuate recesses 16*d* engage disc 18*a*, they hold said disc captive while permitting rotary movement between them. This couples the tractor to the trailer and enables the tractor to pull the trailer and to turn relative thereto.

It will further be observed that disc 18*a* can be forced to a position forward of recesses 16*d*. See FIG. 8. This can be done by simply pushing the tractor and trailer together. The disc is thereby caused to lock behind the blocks 16*c* and to lock the tractor and trailer together. Horizontal abutment 17 on the tractor engages between vertical abutments 17*a* on the trailer, thereby preventing relative pivotal movement between said tractor and said trailer. Similarly, disc 18*a* locks tractor plate 16*a* to trailer plate 14*a* and, together with abutments 17 and 17*a*, immobilizes the tractor and trailer relative to each other. The effective result is a single combined vehicle that can manually be carried or propelled on its wheels on a supporting surface.

Figure 1:
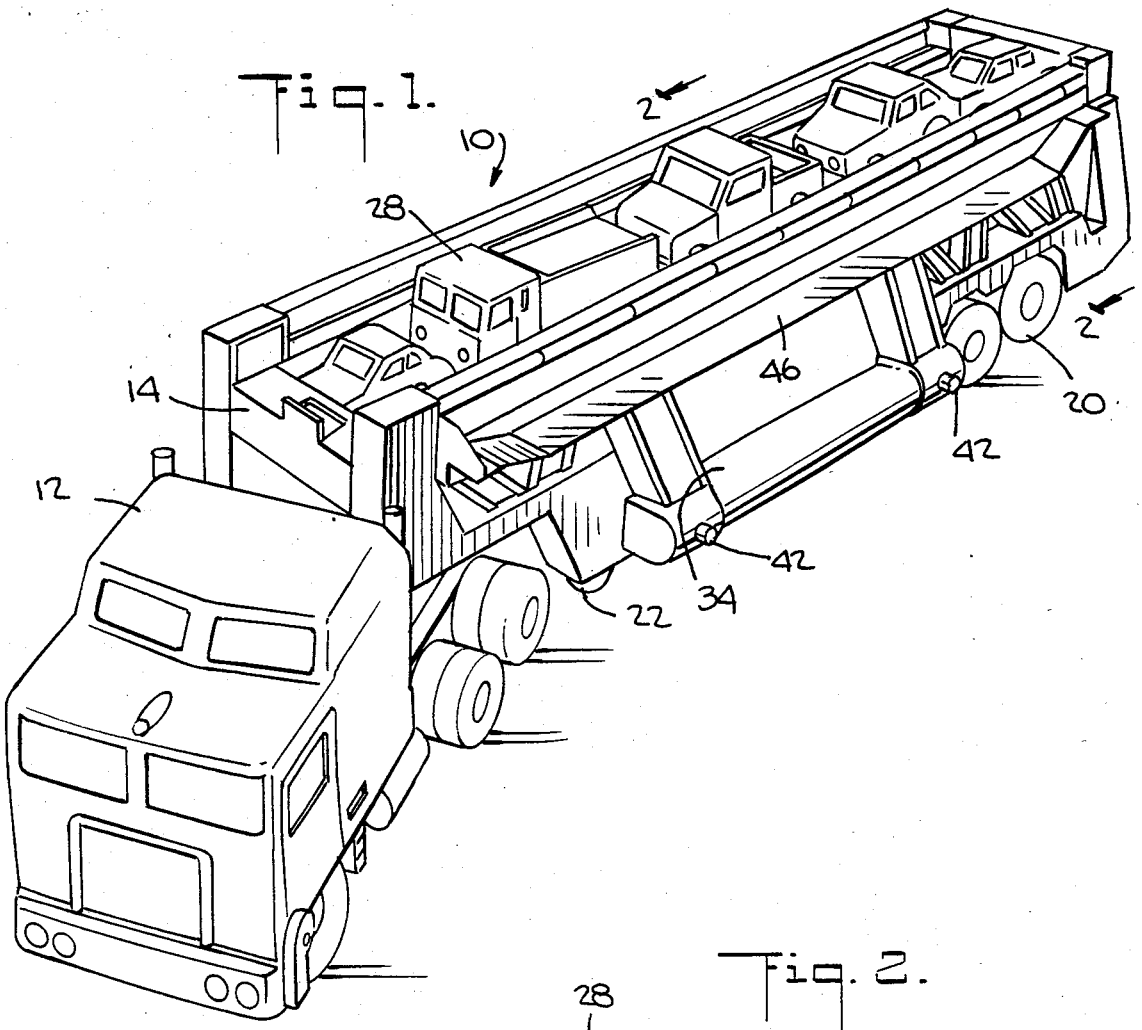
FIG. 1 is a perspective view of a toy car carrier made in accordance with this invention, its handle means being shown in lowered, inoperative position.
Figure 2:
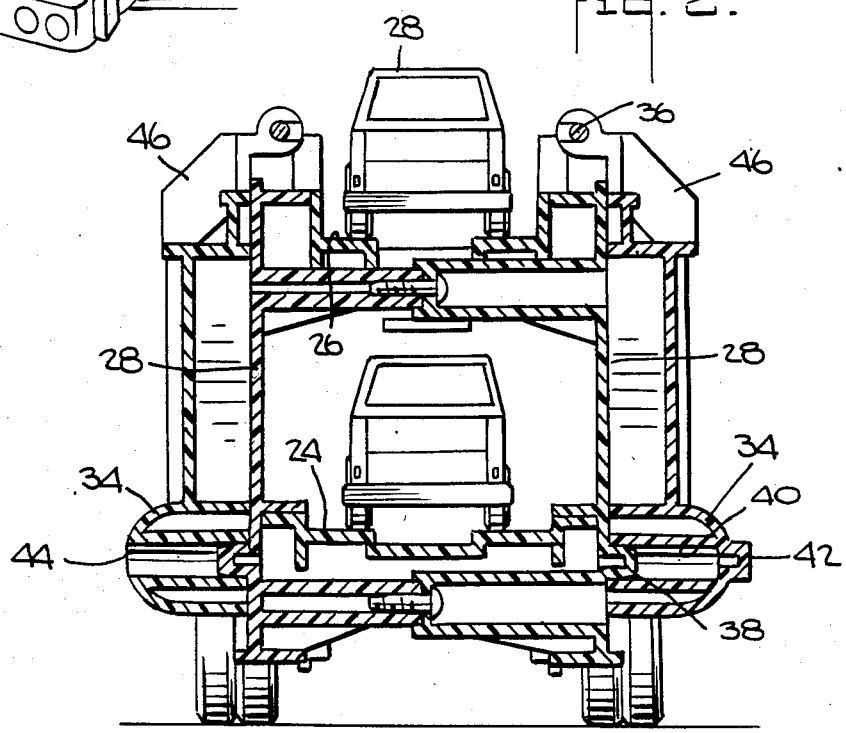
FIG. 2 is a vertical, transverse section on the line 2—2 of FIG. 1.

It will be noted (FIGS. 2 and 4) that the trailer has a lower toy car support 24 and an upper toy car support 26, both adapted to support toy cars 28. The toy cars on the lower support 24 are adequately enclosed within the vehicle, being confined there by the side walls 28, front wall 30 and a rear ramp 32. This ramp may be lowered to its 32a position for loading and unloading the lower toy car support 24. See FIG. 8.

The problem of securing the toy cars on the upper support 26 is more of a problem, especially when the vehicle is manually carried from one location to another. This problem is solved by means of carrying handles 34 which are pivotally mounted on longitudinally extending, horizontal rods 36 supported on opposite sides of the trailer. The handles are pivotally movable between their lower, inoperative position (FIG. 2) and their upper, operative position (FIG. 4).

To hold handles 34 in their lower, inoperative position, any suitable disengageable securing means may be used, for example plugs 38 on the trailer and cooperative sockets 40 on the handles. They may be frictionally engageable with each other to hold the handles in their lower, inoperative position. But they are disengageable to free the handles for pivotal movement to their upper, operative position. To hold handles 34 in their upper, operative position, plugs 42 on one handle engage sockets 44 on the other handle. See FIG. 4.

Figure 3:
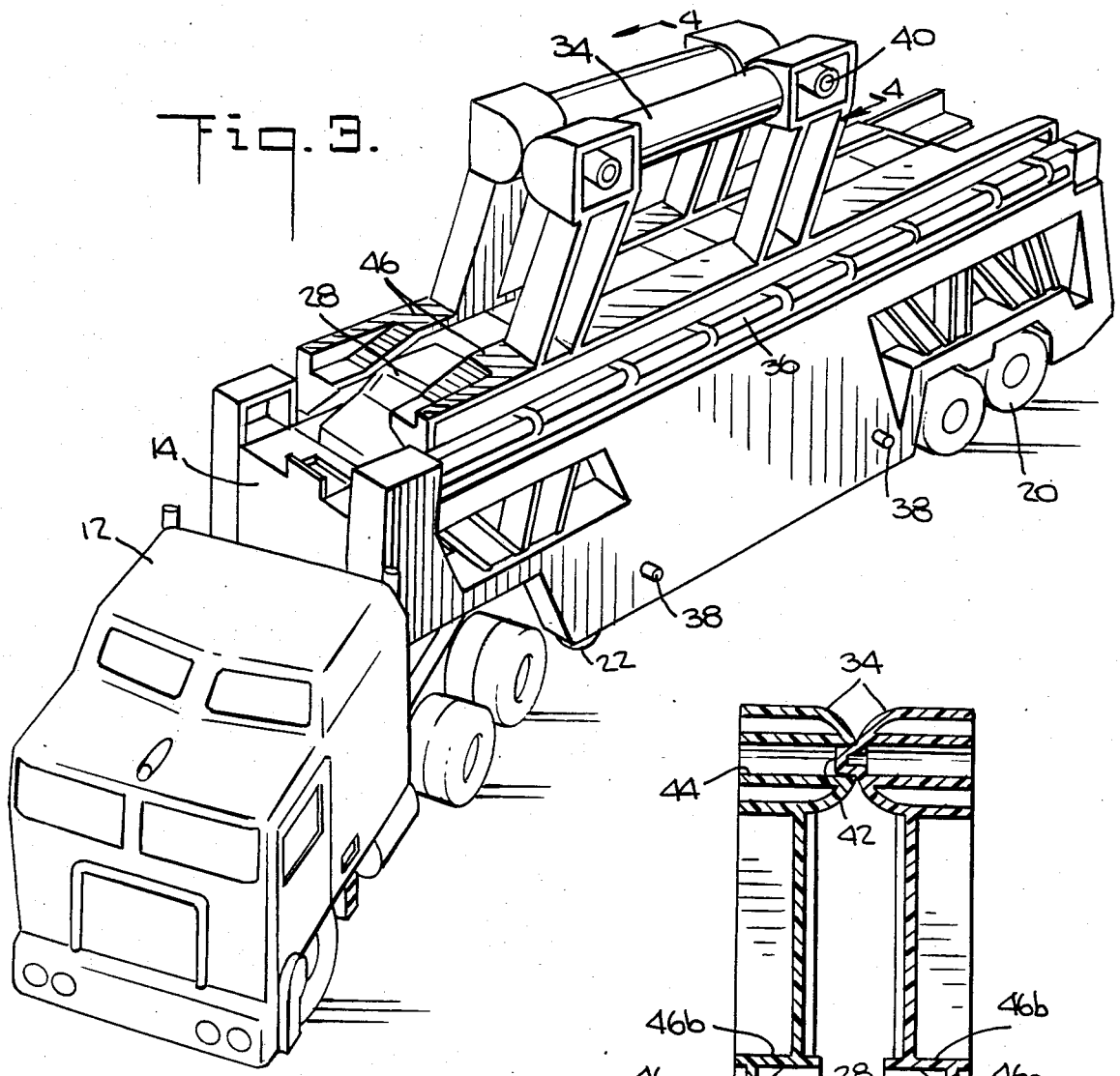
FIG. 3 is a perspective view similar to that of FIG. 1 but showing the handle means in raised, operative position.
Figure 4:
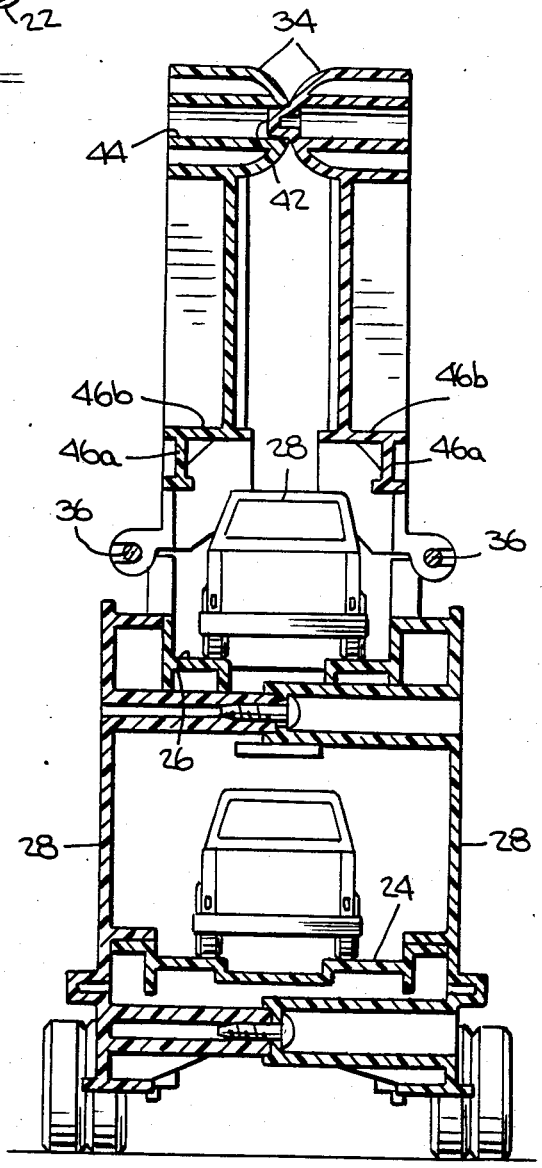
FIG. 4 is a vertical transverse section on the line 4—4 of FIG. 3.

It will be observed in FIGS. 3 and 4 that the handles are supported by arms 34*a* secured to longitudinally extending, horizontal angle bars 46 paralleling the line of toy cars on the upper car support 26. These bars define both vertical and horizontal flanges 46*a* and 46*b*, respectively, which function to confine the toy cars to said upper car support when the vehicle is carried from location to location by means of the handles.

Figure 6:
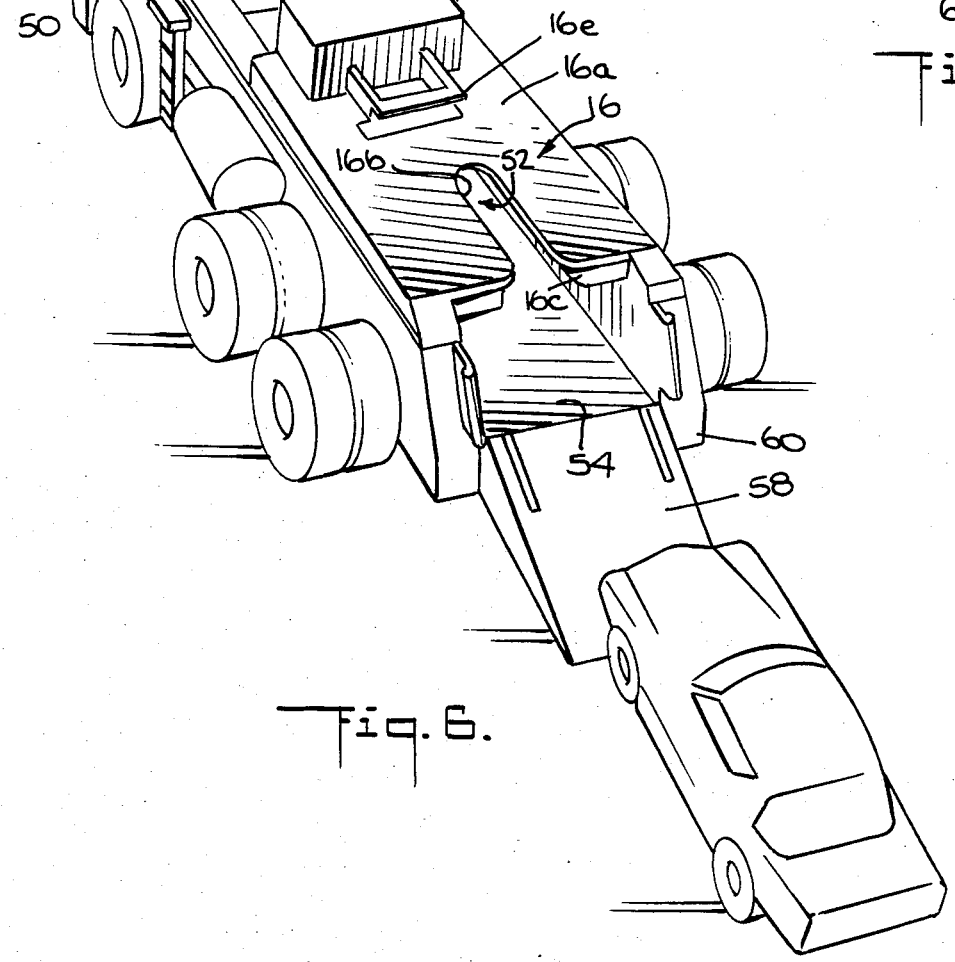
FIG. 6 is a similar perspective view of the tractor component of the toy car carrier, but showing its cab elevated and ramp lowered to expose the car carrying capability of the tractor.
Figure 7:
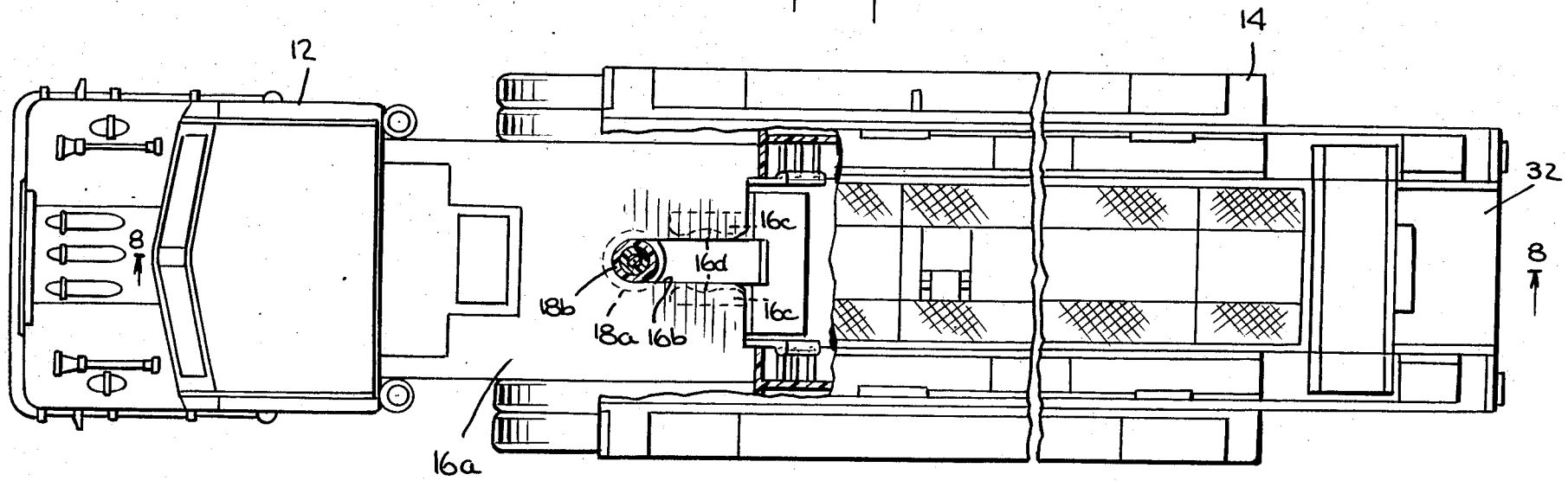
FIG. 7 is a fragmentary top view of the toy car carrier with parts broken away and in horizontal section to show the tractor and trailer fixed to each other for carrying purposes.

Referring now to tractor 12, FIGS. 5 and 6 show that it includes a pivotable cab 48 which is pivotally movable between its normal, lowered position (FIG. 5) and its raised, inoperative position (FIG. 6). The pivotal axis is defined by horizontal crosspin 50 on which the cab is pivotally mounted.

Moving the cab to its raised position exposes a compartment 52 for toy cars. At the bottom of the compartment is a platform 54 which serves as support means for the toy cars. A ramp 58 is pivotally attached to chassis 60 of the tractor immediately behind platform 54. When the ramp is lowered (FIG. 6) toy cars may be rolled onto and off said platform. When the ramp is raised (FIG. 5) it prevents the toy cars from rolling off the platform.

It will be understood that the above-described embodiment of the invention may be modified in many ways without changing the principles or enlarging the scope of the invention. For example, the holding means for holding the handles in operative or inoperative position may consist of only a single plug-and-socket set wherever two such sets are shown in the drawing, or a plurality of such sets larger than two. Conventional devices other than the plug-and-socket device may be used. The handles may have different configurations from the configuration shown in the drawing, and they may be provided with different toy car confining parts. The vehicle itself may be made of any suitable material, any conventional car transporting type. Other variations within the scope of the claims are contemplated.

We claim:

1. A toy car carrier comprising:

a. a toy car transport vehicle, b. wheels mounted on said vehicle, adapting it to be supported and moved on a supporting surface, c. support means on said vehicle for supporting toy cars, and d. a pair of handles mounted on opposite sides of said vehicle for movement upwardly into operative position and downwardly into inoperative position, e. said handles, when in operative position, being provided with means for confining the toy cars to said support means, f. said handles, when in operative position, being adapted for carrying the vehicle or for propelling it on its wheels on a supporting surface.

2. A toy car carrier in accordance with claim 1, wherein:

a. the handles are pivotally mounted on said vehicle on parallel axes extending longitudinally of the vehicle, b. whereby the handles are movable into operative and inoperative positions by pivotal movement about said axes.

3. A toy car carrier in accordance with claim 1, wherein:

a. handle holding means are provided to hold the handles in either operative or inoperative position, b. said handle holding means being disengageable to free the handles from one position for movement into the other position.

4. A toy car carrier comprising:

a. a toy car transport vehicle, b. support means on said vehicle for supporting toy cars, and c. a pair of handles mounted on opposite sides of said vehicle for movement upwardly into operative position and downwardly into inoperative position, d. said handles being provided with means for confining the toy cars to said support means when the handles are in their operative position, e. handle holding means being provided to hold the handles in either operative or inoperative position, f. said handle holding means being disengageable to free the handles from one position for movement into the other position, g. said handle holding means comprising cooperative plugs and sockets, h. said plugs and sockets being engageable with each other to hold the handles in either operative or inoperative position, i. said plugs and sockets being disengageable from each other to enable the handles to move from operative to inoperative position and back.

5. A toy car carrier comprising:

a. a toy car transport vehicle, b. support means on said vehicle for supporting toy cars, and c. a pair of handles mounted on opposite sides of said vehicle for movement upwardly into operative position and downwardly into inoperative position, d. said handles being provided with means for confining the toy cars to said support means when the handles are in their operative position, e. handle holding means being provided to hold the handles in either operative or inoperative position, f. said handle holding means being disengageable to free the handles from one position for movement into the other position, g. the handle holding means comprising cooperative plugs and sockets, h. said plugs and sockets being engageable with each other to hold the handles in either operative or inoperative position, i. said plugs and sockets being disengageable from each other to enable the handles to move from operative or inoperative position and back, j. at least one plug being provided on one handle and at least one socket being provided on the other handle, k. said plug and socket being in registration with each other when the handles are in operative position,
l. whereby said plug and socket are adapted to engage each other to hold the handles in operative position.

6. A toy car carrier comprising:
a. a toy car transport vehicle,
b. support means on said vehicle for supporting toy cars, and
c. a pair of handles mounted on opposite sides of said vehicle for movement upwardly into operative position and downwardly into inoperative position,
d. said handles being provided with means for confining the toy cars to said support means when the handles are in their operative position,
e. handle holding means being provided to hold the handles in either operative or inoperative position,
f. said handle holding means being disengageable to free the handles from one position for movement into the other position,
g. the handle holding means comprising cooperative plugs and sockets,
h. said plugs and sockets being engageable with each other to hold the handles in either operative or inoperative position,
i. said plugs and sockets being disengageable from each other to enable the handles to move from operative to inoperative position and back,
j. at least one plug and one socket being provided between each handle and the vehicle when the handles are in inoperative position,
k. said plug and socket being in registration with each other when the handles are in inoperative position,
l. whereby said plug and socket are adapted to engage each other to hold the handles in inoperative position.

7. A toy car carrier in accordance with claim 1, wherein:
a. the means for confining the toy cars comprises a pair of longitudinally extending bars, one in each handle,
b. said bars being situated on opposite sides of the toy cars on the support means when the handles are in operative position,
c. whereby the toy cars are confined to said support means when the vehicle is carried by means of said handles.

8. A toy car carrier in accordance with claim 7, wherein:
a. the longitudinally extending bars are provided with both horizontal and vertical components,
b. said components being adapted to prevent both vertical and horizontal displacement of the toy cars.

9. A toy car carrier comprising:
a. a toy car transport vehicle,
b. support means on said vehicle for supporting toy cars, and
c. a pair of handles mounted on opposite sides of said vehicle for movement upwardly into operative position and downwardly into inoperative position,
d. said handles being provided with means for confining the toy cars to said support means when the handles are in their operative position,
e. the toy car transport vehicle comprising tractor and a trailer,
f. the handles being mounted on the trailer,
g. said tractor being connected to said trailer and being supportable by the trailer when the trailer is carried by means of said handles,
h. whereby the entire toy car transport vehicle is carried when the trailer is carried.

10. A toy car carrier comprising:
a. a toy car transport vehicle,
b. support means on said vehicle for supporting toy cars, and
c. a pair of handles mounted on opposite sides of said vehicle for movement upwardly into operative position and downwardly into inoperative position,
d. said handles being provided with means for confining the toy cars to said support means when the handles are in their operative position,
e. the toy car transport vehicle comprising a tractor and a trailer,
f. said tractor having a coupling mount and said trailer having a coupler which is detachably coupled to said coupling mount for relative pivotal movement between said tractor and said trailer about the coupling axis.

11. A toy car carrier comprising:
a. a toy car transport vehicle,
b. support means on said vehicle for supporting toy cars, and
c. a pair of handles mounted on opposite sides of said vehicle for movement upwardly into operative position and downwardly into inoperative position,
d. said handles being provided with means for confining the toy cars to said support means when the handles are in their operative position,
e. the toy car transport vehicle comprising a tractor and a trailer,
f. said tractor having a coupling mount and said trailer having a coupler which is detachably coupled to said coupling mount for relative pivotal movement between said tractor and said trailer about the coupling axis,
g. the coupling mount being provided with accurate block elements on opposite sides of the coupling axis,
h. said coupler having a disc element centered on said coupling axis,
i. said disc element being engageable by said accurate block elements to couple the tractor to the trailer and provide for the relative pivotal movement between them.

12. A toy car carrier comprising:
a. a toy car transport vehicle,
b. support means on said vehicle for supporting toy cars, and
c. a pair of handles mounted on opposite sides of said vehicle for movement upwardly into operative position and downwardly into inoperative position,
d. said handles being provided with means for confining the toy cars to said support means when the handles are in their operative position,
e. the toy car transport vehicle comprising a tractor and a trailer,
f. said tractor having a coupling mount and said trailer having a coupler which is detachably coupled to said coupling mount for relative pivotal movement between said tractor and said trailer about the coupling axis,
g. the coupling mount being provided with accurate block elements on opposite sides of the coupling axis, h. said coupler having a disc element centered on said coupling axis, i. said disc element being engageable by said accurate block elements to couple the tractor to the trailer and provide for relative pivotal movement between them, j. the disc element being movable past the accurate block elements and into a position where it is locked behind said accurate block elements to prevent relative longitudinal movement between the tractor and trailer, k. said tractor and trailer being also provided with locking means to prevent relative vertical movement between them and to prevent relative angular movement about a vertical axis, l. whereby the tractor and trailer are immobilized relative to each other for carrying purposes.

13. A toy car carrier comprising:

a. a toy car transport vehicle, b. support means on said vehicle for supporting toy cars, and c. a pair of handles mounted on opposite sides of said vehicle for movement upwardly into operative position and downwardly into inoperative position, d. said handles being provided with means for confining the toy cars to said support means when the handles are in their operative position, e. the toy car transport vehicle comprising a tractor and a trailer, f. the handles being mounted on the trailer, g. said tractor being connected to said trailer and being supportable by the trailer when the trailer is carried by means of said handles, h. whereby the entire toy car transport vehicle is carried when the trailer is carried, i. the tractor being provided with a toy car carrying compartment and with ramp means for access thereto when the tractor and trailer are uncoupled, j. said ramp means being pivotally movable into closed position relative to said compartment to confine toy cars therein.

* * * * *